US005624375A

United States Patent [19]

Dykes et al.

[11] Patent Number: 5,624,375

[45] Date of Patent: Apr. 29, 1997

[54] INCUBATOR TILT MECHANISM

[75] Inventors: Christopher A. Dykes, Odenton; Robert M. Simenauer, Ellicott City, both of Md.

[73] Assignee: Ohmeda Inc., Liberty Corner, N.J.

[21] Appl. No.: 427,182

[22] Filed: Apr. 21, 1995

[51] Int. Cl.[6] ..... A47G 29/00; A47F 5/12

[52] U.S. Cl. ..... 600/22; 108/7; 108/9

[58] Field of Search ..... 600/22; 108/1–19

[56] References Cited

U.S. PATENT DOCUMENTS

| | | | |
|---|---|---|---|
| 2,366,630 | 1/1945 | Kreiselman | 600/22 |
| 2,633,842 | 4/1953 | Higgs | 600/22 |
| 4,474,115 | 10/1984 | Carlton | 108/7 |
| 4,885,918 | 12/1989 | Vaccaro | 600/22 |
| 4,934,647 | 6/1990 | Edwards | 108/10 |
| 5,131,333 | 7/1992 | Karasawa et al. | 108/7 |

FOREIGN PATENT DOCUMENTS

| | | | |
|---|---|---|---|
| 0089902 | 3/1982 | France | 108/7 |

*Primary Examiner*—Angela D. Sykes
*Assistant Examiner*—Stephen D. Huang
*Attorney, Agent, or Firm*—Roger M. Rathbun; R. Hain Swope

[57] ABSTRACT

A tilt mechanism for use with an infant care apparatus such as an incubator to place and retain the infant care apparatus in a desired tilt angle. The tilt mechanism includes two sets of crossed links, each set forming an X between the links. One end of each link is rotatable affixed to a fixed base and the other end rotatably affixed to the infant care apparatus. A locking device is used that allows the infant apparatus to be manually moved by means of the crossed link sets to the desired angle and then locked into that position. With this mechanism, the entire infant apparatus is tilted rather than only some internal bed or infant platform.

12 Claims, 7 Drawing Sheets

INCUBATOR TILT MECHANISM

BACKGROUND OF THE INVENTION

This invention relates to infant care equipment, such as incubators, and, more particularly, to a mechanism for adjusting the angular position of infant care equipment.

There is, of course, a need in the care for infants, to place the infant at an angular position, either with the head raised or the feet raised in order to create a particular desired environment for the infant, i.e. the Trendelenberg and Fowler positions. Current incubators have various means of providing that tilt to the infant, one of which is shown and described in U.S. Pat. No. 4,734,945 and which provides a mechanism within the incubator that tilts the bed or platform on which the infant is positioned.

In the current tilt mechanisms, however, much of the actual mechanism is inside the infant incubator and therefore takes up room that otherwise may be used for other purposes. Such mechanisms are placed underneath the infant bed within the incubator and include various means of operating the mechanisms from outside the incubator. As a further problem, when the infant bed itself is elevated, a portion of the infant is thereby raised up from the normal position within the incubator and access to the infant itself is thus impeded when the user opens the front door to attend to the infant. In addition, since some tilting mechanisms actually operate through or directly adjacent the front door, the operation of the door itself may be compromised.

SUMMARY OF THE INVENTION

There is herein described, a tilt mechanism for use with infant care equipment in which the incubator itself does not contain any of the mechanism needed to carry out the tilting function. As used, herein, reference will be made in the preferred embodiment to an infant incubator, however, the present tilt mechanism may readily used with other infant care equipment where the angular position of the infant needs to be changeable, such other equipment including infant warmers.

The present tilt mechanism is positioned underneath the infant incubator itself and acts to tilt the position of the entire incubator, thus, access to the infant through the front door or to other parts of the interior of the incubator are not impeded by the position of a tilted mattress within the incubator.

The infant incubator may be tilted to the desired position and the inherent stability of the mechanism can maintain the incubator in that position, however, in the preferred embodiment, a locking means may further be employed to rigidly lock the infant apparatus into the desired tilt angle. One such locking mechanism can readily be a simple hydraulic cylinder where the infant incubator may be tilted to any desired position and maintained in that position by merely stopping the flow of hydraulic fluid within the hydraulic cylinder.

The present tilt mechanism therefore can be used with a variety of incubators and the angular position of the incubator readily changed as desired and the position maintained as long as desired. As a further feature, the tilt mechanism is inherently stable as the center of gravity moves during other tilting process only slightly and then to a position of good stability.

BRIEF DESCRIPTION OF THE DRAWINGS

The invention is diagrammatically illustrated by way of example in the drawings appended hereto in which.

DESCRIPTION OF THE PREFERRED EMBODIMENT

Figure 1A:
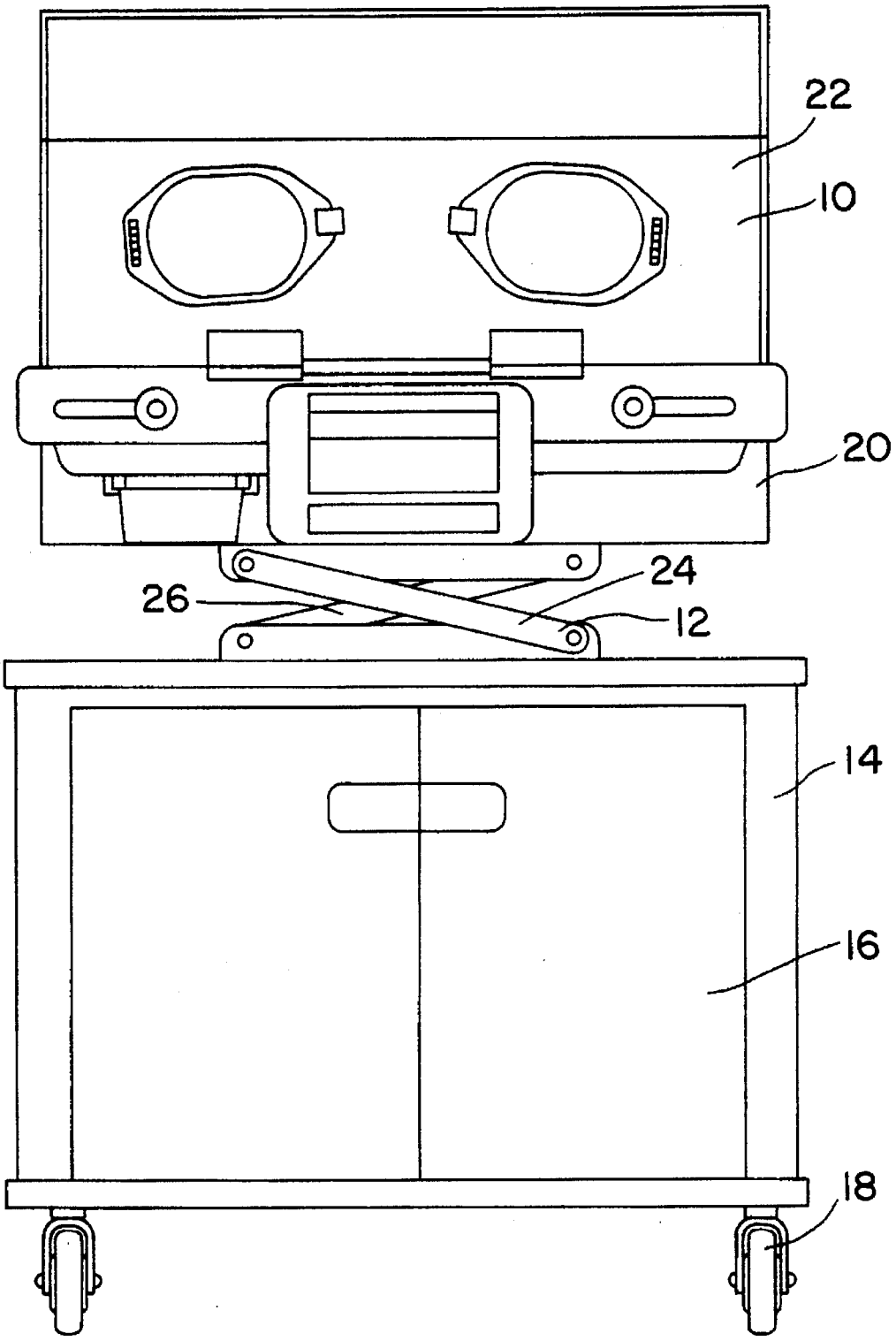
FIGS. 1A, 1B and 1C are schematic views of an infant care apparatus tiltable by a tilting mechanism constructed in accordance with the present invention.
Figure 1B:
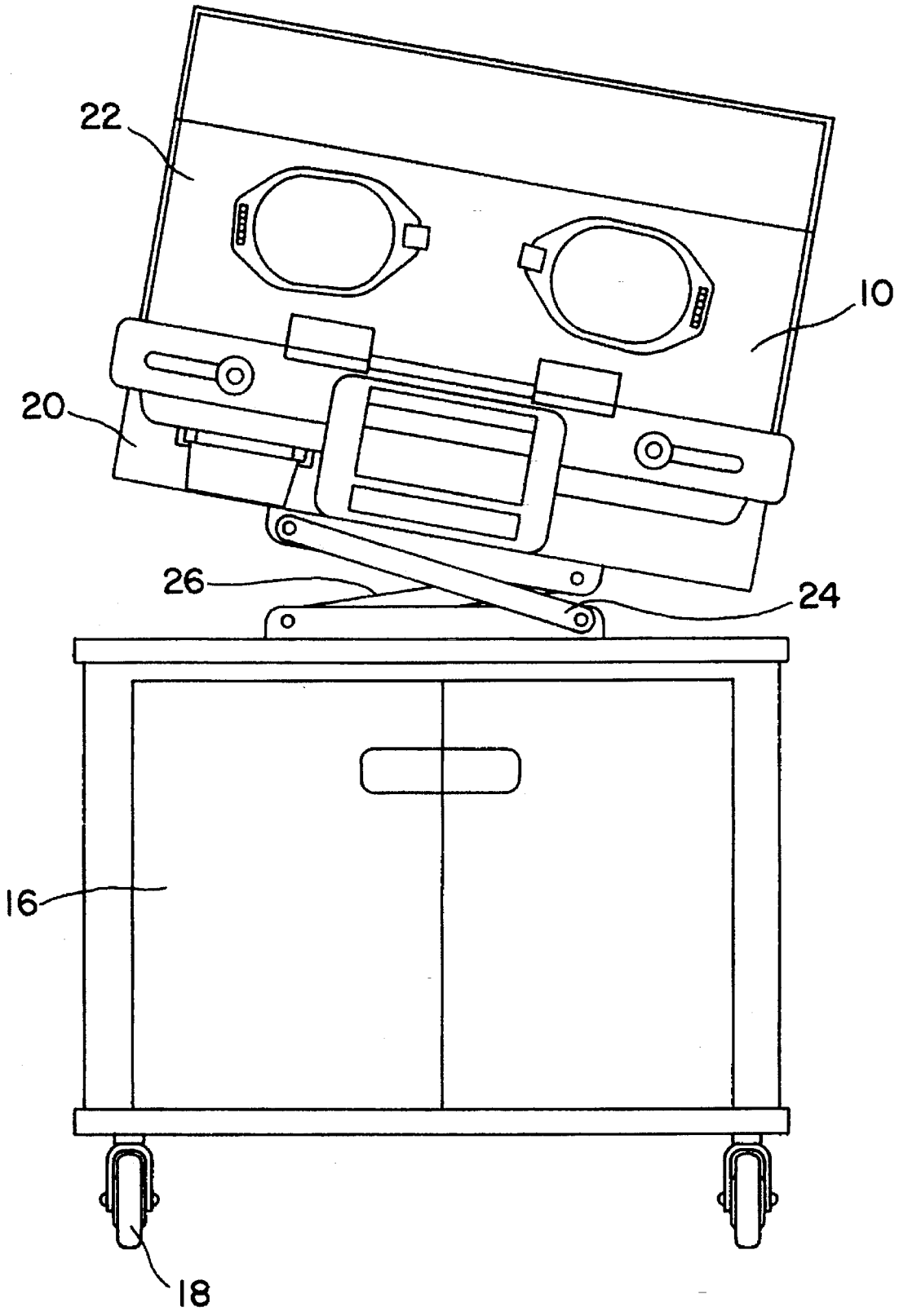
Figure 1C:
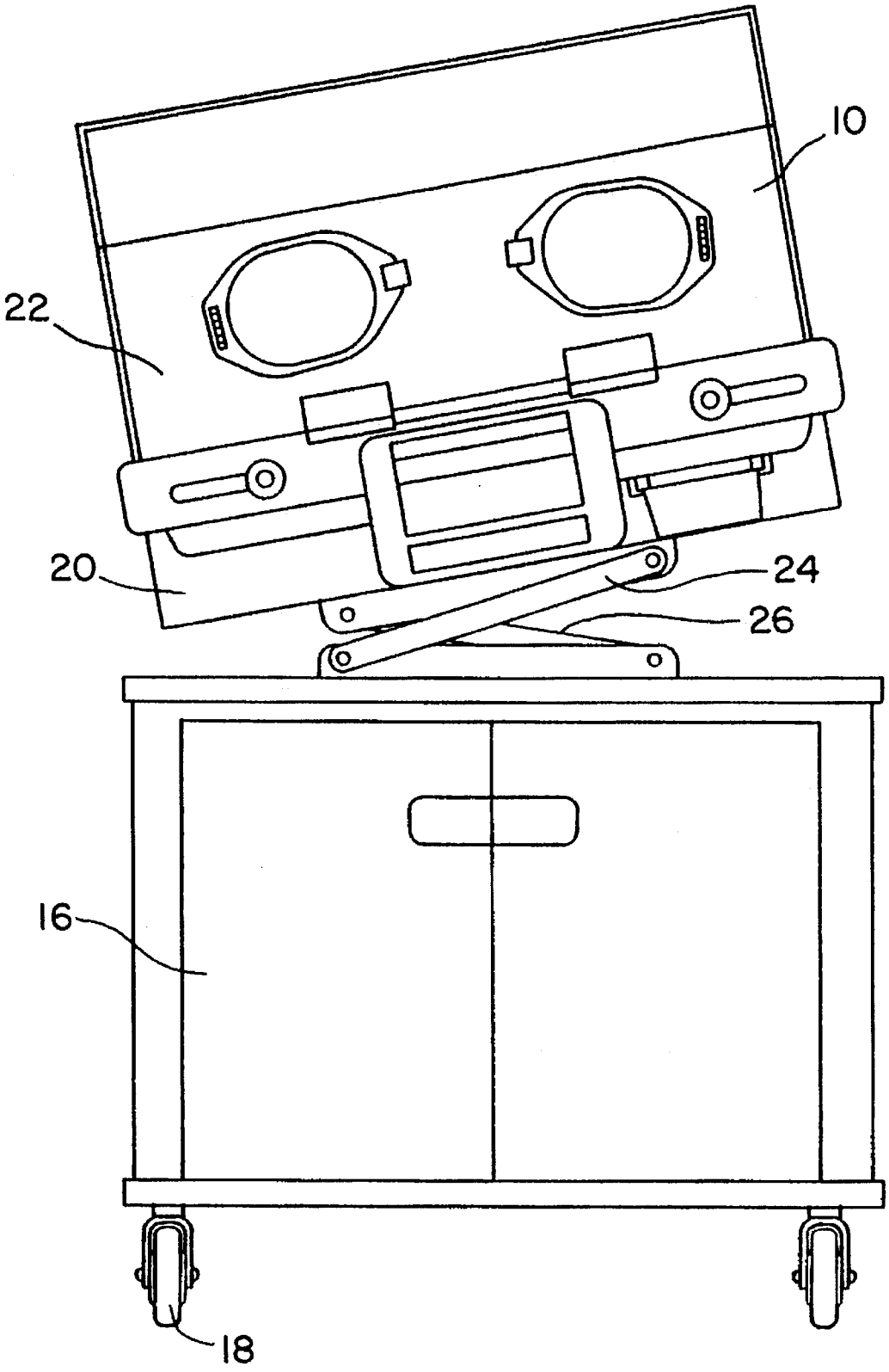

In FIGS. 1A–1C, there are shown schematic views of an infant incubator 10 that is tiltable to various positions by means of tilt mechanism 12 positioned intermediate the infant incubator 10 and a support base 14. As is conventional, the base 14 supports the infant incubator 10 and may include doors 16 for cabinet space to store various materials for attending to the infant and may further include wheels 18 for easily moving the infant incubator 10 from one location to another within the infant care environment.

As previously explained, the present description will be with reference to an infant incubator, it being understood, however, that the same tilt mechanism may be used with other infant care apparatus, such as infant warmers, bassinets etc. that require a change of angle of the infant in carrying out certain therapy.

The infant incubator 10 itself is basically conventional and may be constructed in accordance with the incubator shown and described in U.S. Pat. No. 4,936,824 of Koch et al and the description in that patent is incorporated herein. As part of the present invention, however, the same tilt mechanism may be used with any incubator, including the intensive care incubator of Maluta, U.S. Pat. No. 4,321,913, the emphasis being that the present tilt mechanism can be used with any infant care apparatus since it tilts the apparatus itself and not merely the internal bed or other internal structures of the infant care apparatus.

The incubator 10 includes a base 20 made of a structural plastic material and which contains the equipment and controls necessary for a functioning incubator. A transparent hood 22 sits atop the base 20 of infant incubator 10 and allows the attending personnel to view into the infant incubator 10 to keep a visual contact with the infant contained therein. As better described in the aforementioned U.S. Pat. No. 4,936,824, the hood 22 also generally includes a front door, hand holes and the like for access to the infant.

As shown in FIG. 1, the infant incubator 10 is at its level, horizontal position and is supported in that position by the tilt mechanism 12 and which includes a pair of links, a first link 24 and a second link 26 that are crossed to form an X with respect to each other. A similar set of crossed links are provided at the rear of the incubator 10 but are not shown in FIG. 1A. As used, herein, the separate pairs of crossed links are referred to by their relative position with respect to the incubator 10, the set of crossed links shown in FIG. 1A, i.e. first and second links 24, 26 are the front pair while the pair, not shown and which are positioned nearer the rear of the infant incubator 10 are the rear pair of crossed links, it being clear that two sets are utilized and which are positioned opposite each other. In the preferred embodiment, the pairs of crossed links are positioned near the front and rear of the infant incubator 10 so that the tilting of the infant incubator 10 will occur along its length so as to tilt the infant contained therein to raise or lower the head with respect to the infant's feet.

It will be noted that the front and rear crossed links are similar in operation and construction such that the description of the FIGS. 1A–1C Figures will describe only the front crossed links, first link 24 and second link 26. The rear crossed links are basically mirror images of the front crossed links.

Both the first and second links 24 and 26 are mounted in a similar fashion, that is, both have one end thereof rotatably affixed to the base 20 of the infant incubator 10 and the other ends rotatably affixed to the support base 14. It should be noted that unlike scissor type of mechanisms, there is no connection, such as at the center, between the individual links 24 and 26. The connections between the ends of the first and second links 24 and 26 and the base 20 of the infant incubator 10 and the ends connecting to the support base 14 are only rotatable junctions, in no instance does any end of a link move laterally with respect to the incubator base 20 or the support base 14.

As shown in FIG. 1, when the infant incubator 10 is in the level position, the infant incubator 10 is raised from the support base 14 and the amount that such infant incubator 10 is raised is determined by the length of the first and second links 24 and 26. It is preferable, and necessary to the operation of the tilting mechanism 12 that there be some clearance between the incubator base 20 and the support base 14 as will become apparent.

In FIG. 1B, the infant incubator 10 is shown tilted to the right and in FIG. 1C, the infant incubator 10 is shown as tilted to the left. Either position is sometimes desirable for the positioning of an infant and the exact position depends upon the particular therapy being provided to the infant.

Figure 2A:
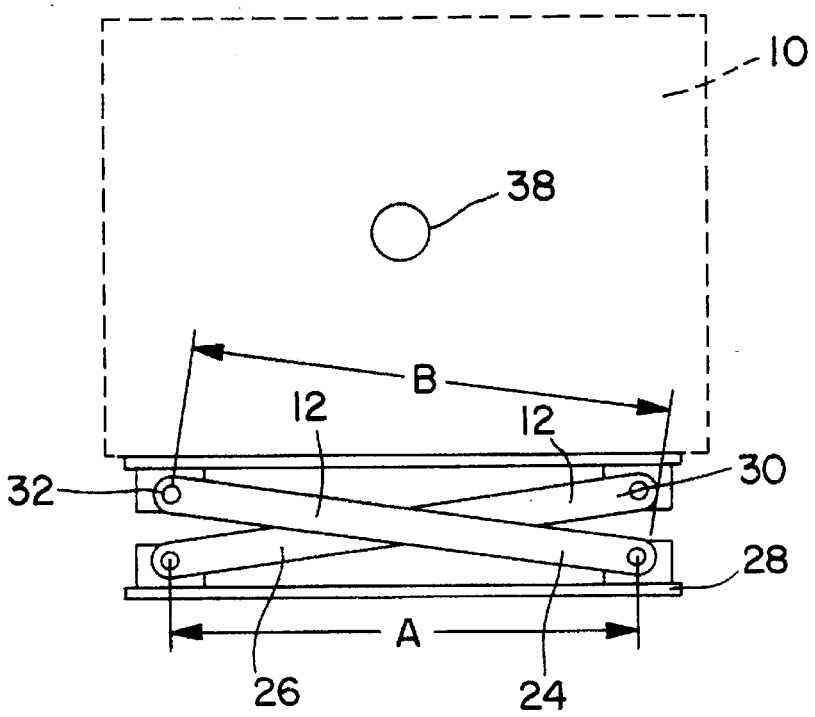
FIGS. 2A and 2B are schematic views illustrating the overall tilting mechanism and demonstrating the inherent stability of the tilt mechanism of the present invention.
Figure 2B:
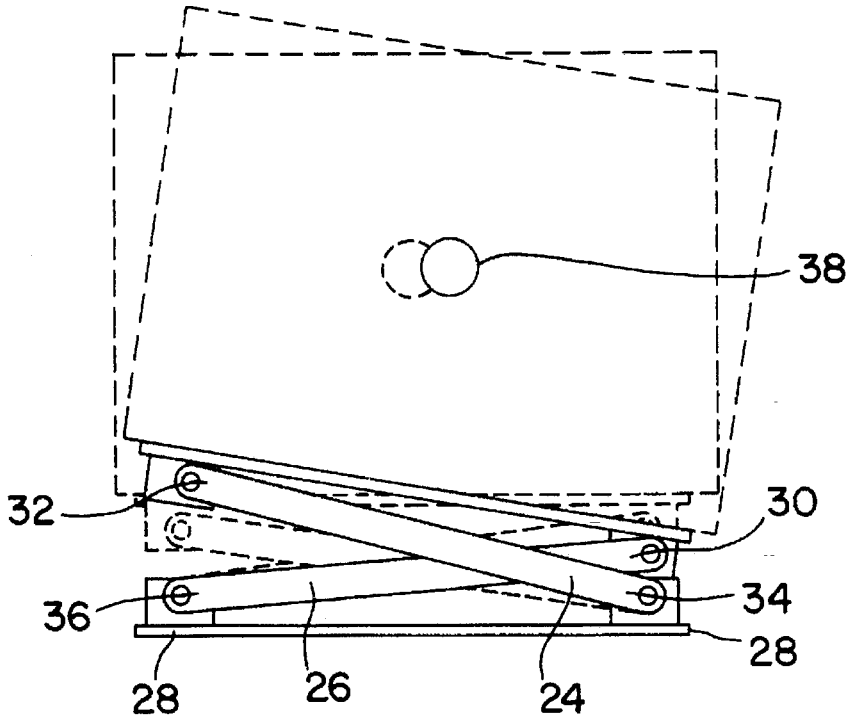

Turning now to FIGS. 2A and 2B, there is shown schematic views of the tilt mechanism 12 of the present invention and illustrating the inherent stability of the system. In FIGS. 2A and 2B, the incubator 10 is merely shown, for purposes of illustration, as a rectangular box and the tilt mechanism 12 is positioned between the infant incubator 12 and a base plate 28. First and second links 24 and 26 are shown and which are rotatable connected to the infant incubator at pivot points 30 and 32 and to the base plate 28 at pivot points 34 and 36. The center of gravity of infant incubator 10 is diagrammatically illustrated at point 38.

In FIG. 2A, therefore, when the infant incubator 10 is its level position, the center of gravity 38 is central located. As the infant incubator is tilted by means of the tilt mechanism 12, the new position of the center of gravity is shown in FIG. 2B in the solid lines; the center of gravity 38 in the original, untilted position is shown in dotted lines. As can be seen, the center of gravity 38 of infant incubator 12 has moved laterally to the right and risen slightly, thereby making the infant incubator 10 stable and potentially self righting. In addition, as can be seen, in the event of a failure of the tilt locking mechanism 12, the system will return the infant incubator 10 to its level position, thereby preventing the system from inadvertently overtilting the infant incubator 10 to the point where the infant is in a stressed tilt position.

As is also noted on FIGS. 2A and 2B, the horizontal length of the base axis is indicated as a length A and the length of a link is indicated as a length B. By simply modifying the lengths A and B of the base axis and moving links, the dynamic and static movements of the mechanism may be changed as desired. Thus, by changing such lengths, the mechanism may have the characteristic that it will tend to return to a self righting position or, in the alternative, the mechanism can have the characteristic that it will tend to remain in the position to which it is moved. Accordingly, the characteristic of the tilt mechanism may, to a great extent, be determined and designed into the mechanism by means of the selection of the lengths A and B as shown in FIGS. 2A and 2B.

Figure 3:
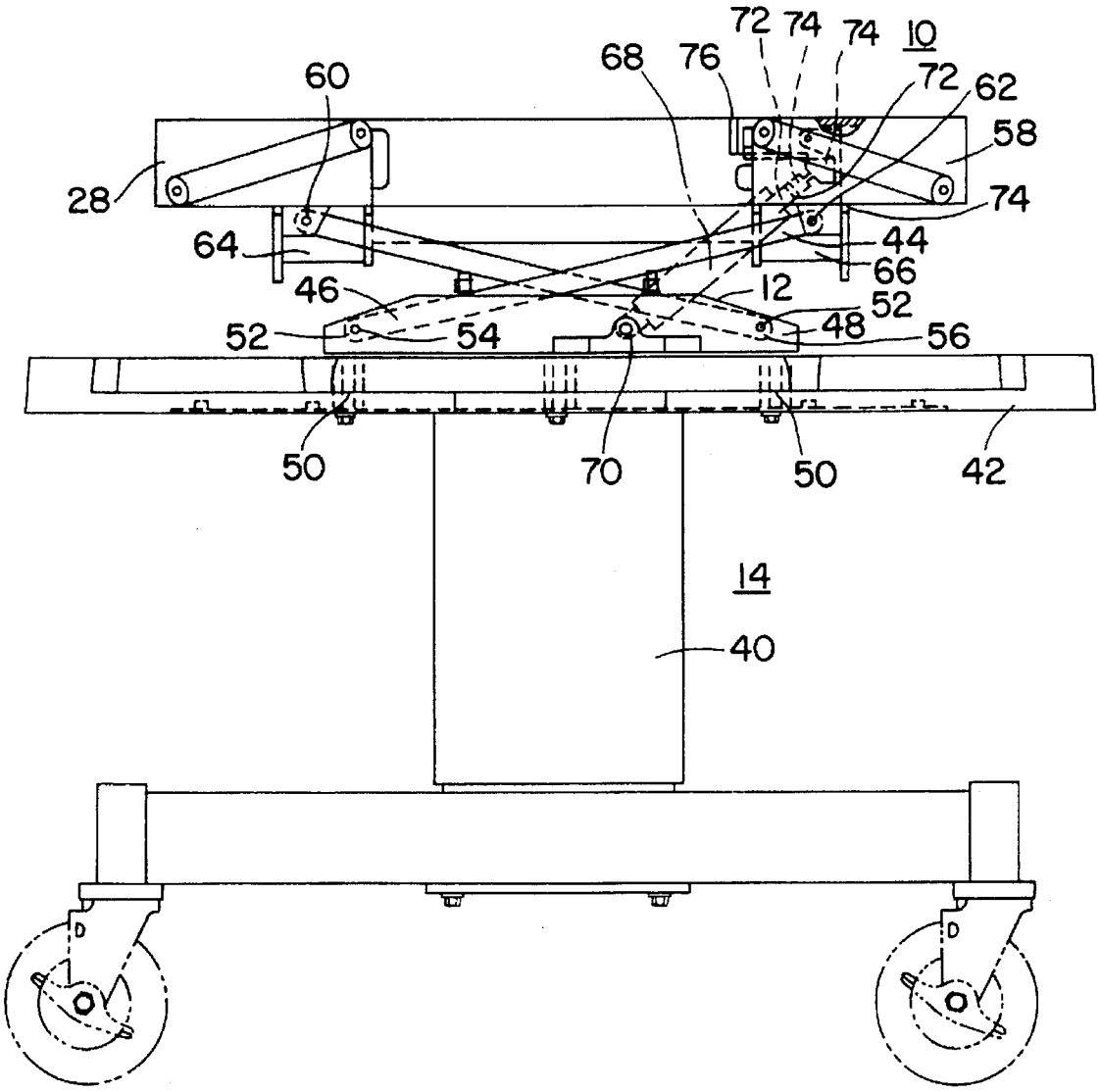
FIG. 3 is a schematic rear view of a tilt mechanism of the present invention showing the components and the locking mechanism used to retain the infant care apparatus in the desired position.

Turning finally to FIG. 3, there is shown, a rear schematic view of an infant tilt mechanism 12 supporting and tilting an infant incubator 10. This view is taken from the rear of the incubator 10 to show that the tilt mechanism 12 is basically the same whether viewed from the front or the rear. In this FIG. the support base 14 comprises an elevating column 40 which allows the user to raise or lower the infant incubator 10. Mounted atop the elevating column 40 is a table top 42 to which the tilt mechanism 12 is affixed. The tilt mechanism again includes a pair of crossed links, this time third link 44 and fourth link 46. Each of the links 44 and 46 has one end thereof rotatably attached to the table top 42 and the other end thereof rotatable affixed to the base plate 28, with the respective links forming an X therebetween. As shown, one convenient means of carrying out such attachment is by means of a flange 48 that is affixed to the table top 42 by bolts 50.

Third and fourth links 44 and 46 are thus easily attached to the flange 48 by conventional mean including pins 52 that fit through holes in the flange 48 and which are secured by C-clips. Thus, the third and fourth links 44, 46 are rotatably secured to the table top 42 at pivot points 54 and 56 similar to the pivot points 34 and 36 of FIGS. 1A–1C for the crossed links at the front of the infant incubator 10.

In a similar conventional manner, the other ends of the third and fourth links 44, 46 are rotatably secured to the tiltable base 58. As shown in FIG. 3, the tiltable base 58 is a flat, planar surface upon which any incubator or other infant care equipment may be placed securely, however, it should be noted that the invention can be utilized where the tilt mechanism 12 is affixed directly to the base of the particular piece of equipment and not require the intervention of a flat surface as shown in this FIG. 3.

Again, however, the other ends of the third and fourth links 44, 46 are rotatably affixed to the tiltable base 58 at pivot points 60 and 62 and such pivot points may be formed of conventional means such as pins secured to various flanges such as 64 and 66.

At this point, the tiltable base 58 or, incubator base, is readily tiltable by the operator to move the infant to a head up or feet up position. As indicated, however, the tilt mechanism may, by selecting the dimensions of the various base axis and the links, be made stable when moved to a selected position ow be made to readily return to a stable level position. In the case of infant apparatus, however, ir is also advantageous to add a further locking device to insure that the infant apparatus remains in the particular position selected by the operator and some positive locking mechanism utilized.

An appropriate locking mechanism can thus be provided to retain the tiltable table 58 in the position desired by the user. Basically, that locking mechanism may be of a wide variety of devices to hold the tiltable base 58 in position, one of which is shown in FIG. 3 as a hydraulic cylinder 68. In such embodiment, one end of the hydraulic cylinder 68 is affixed to the table top 42 by a retaining pin 70 contained by retaining rings and the outer end of the piston 72 is secured to the tiltable base 58 by means such as a clamp 74.

Accordingly, as the tiltable base 58 is tilted by the user, the piston 72 moves outwardly or inwardly with respect to the hydraulic cylinder 68. To secure the tiltable base 58 in it desired position, it is only necessary to secure the piston 72 with respect to the hydraulic cylinder 68 and allow it to freely move when the tiltable base 58 is being moved by the user. There are, of course, various ways to lock and release a piston within a hydraulic cylinder, one of which is shown in FIG. 3 where a valving arrangement is provided within the hydraulic cylinder itself operable by a rod 74 extending through the piston 72.

A simple mechanism is thus needed to operate the hydraulic cylinder by depressing and releasing the rod 74 and a release lever 76 may be incorporated into the tiltable base 58 operating a lever 78 to lock or release the movement of the piston. An alternate arrangement may be used such as the closed circuit hydraulic fluid arrangement shown and described in U.S. Pat. No. 4,628,553 of Buttitta et al to allow tilting and locking of an infant care apparatus.

Figure 4:
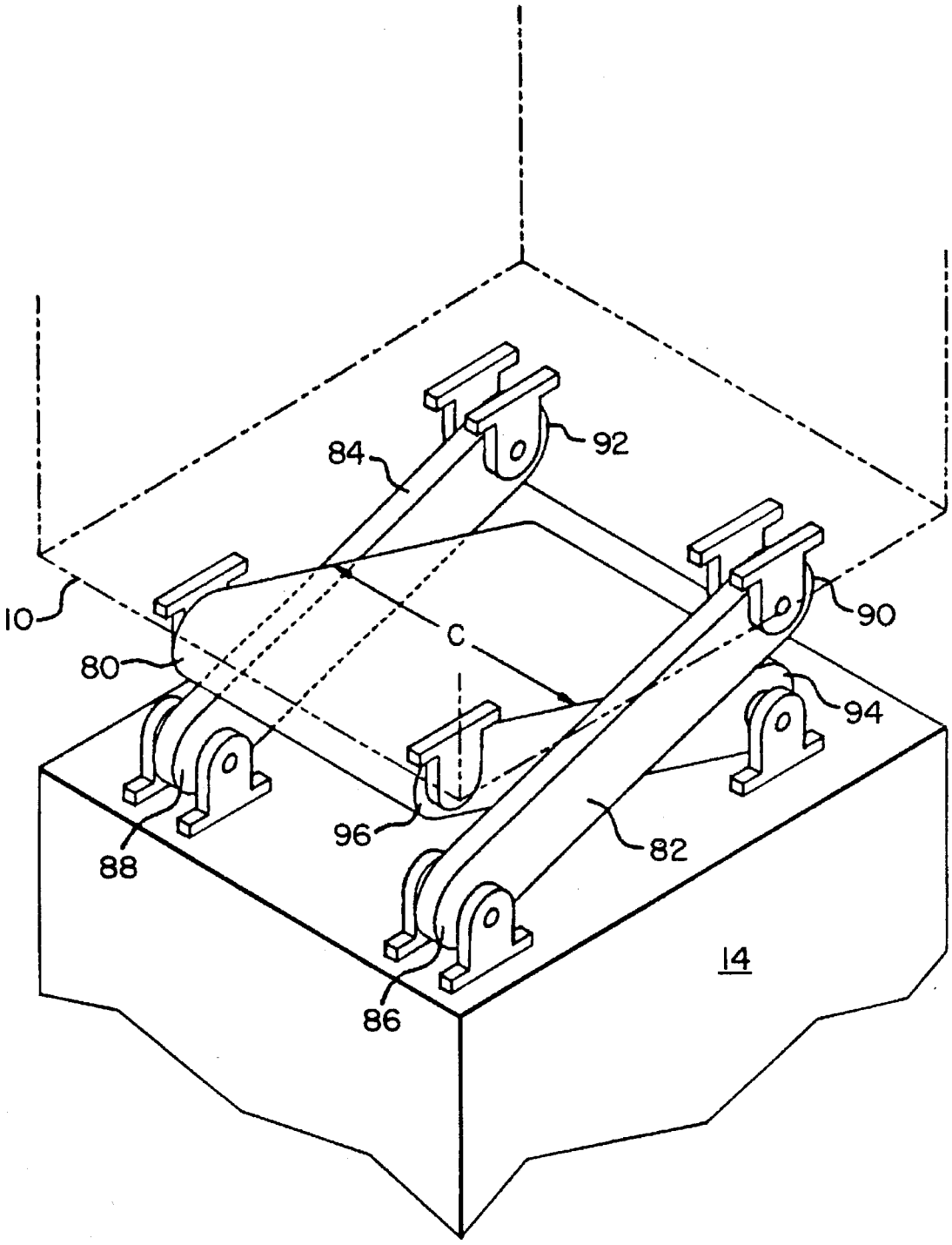
FIG. 4 is a schematic view of a further embodiment of the present invention having an enlarged link replacing two individual links of the FIGS. 2A and 2B embodiment.

Turning next to FIG. 4, there is shown a schematic view of a tilting mechanism of the present invention and where one set of two links of the previous embodiment has been replaced with a laterally elongated link 80. having an elongated lateral width C as shown in the FIG. 4. A further set of links 82 and 84 are also provided and which are positioned similar to the FIG. 2A and 2B embodiment. As before, one end 86 and 88 of each of the links 82 and 84 are affixed to the support base 14 and the other ends 90, 92 are affixed to the base of the infant incubator 10. Each of means of attaching the links are rotatable attachments so that the links 82 and 84 are free to rotate at their points of attachment to infant incubator 10 and support base 14.

The elongated link 80, likewise, has one end 94 rotatably affixed to the support base 14 and the other end 96 rotatably affixed to the base on the infant incubator 10. As before, the means of rotatably attaching any of the links 82, 84 and 80 may be by conventional means and are represented only schematically in the FIG. 4. Accordingly, as may be seen in the FIG. 4 embodiment, the infant incubator 10 may be tilted to various positions with the tilting mechanism even though the tilting mechanism has only three links, one of which is elongated in its lateral dimension.

Figure 5:
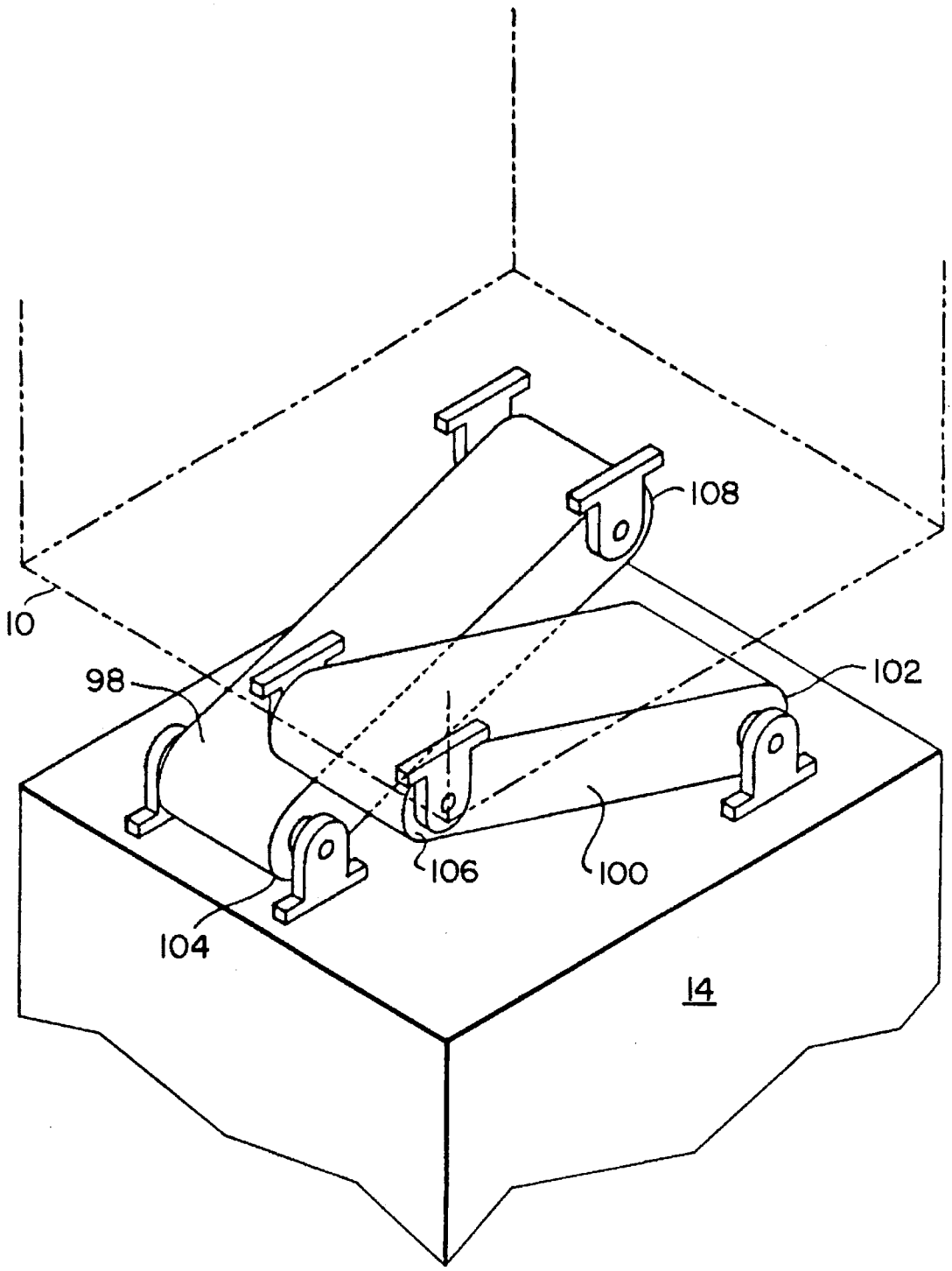
FIG. 5 is a schematic view of a still further embodiment of the present invention having only two elongated links making up the tilting mechanism.

Finally, in FIG. 5, there is shown a schematic view of the crossed linking tilt mechanism of the present invention where only two elongated links 98, 100 are utilized. Again, one end 102, 104 of each of the links 98, 100 are affixed to the support base 14 and the other ends 106, 108 affixed to the base of the incubator 10. Again, the links 98, 100 are rotatably affixed to the incubator 100 and the support base 14 so that they can move freely.

In the case of the FIG. 5 embodiment the elongated links 98, 100 are positioned laterally with respect to each other and, as previously explained, there is no connection between the links along their lengths and they form an X therebetween. As can be readily seen, the overall important feature of the tilt mechanism of the present invention is that the links not be joined to each other but are rotatably affixed to the infant apparatus and to the support base to carry out the present invention.

While the present invention has been set forth in terms of a specific embodiment, it will be understood that the tilt mechanism herein disclosed may be modified or altered by those skilled in the art to other configurations. Accordingly, the invention is to be broadly construed and limited only by the scope and spirit of the claims appended hereto.

We claim:

1. A tilt mechanism for selectively adjusting a tilt angle of an infant apparatus having a front and a rear and adapted to be positioned intermediate the infant apparatus and a fixed base, said tilt mechanism comprising:

at least one first link means having one end thereof rotatably affixed to the fixed base at a fixed point along the fixed base and the other end rotatably affixed to the infant apparatus at a first fixed point on the infant apparatus located adjacent the front of the infant apparatus, at least one second link means having one end thereof rotatably affixed to the fixed base at a fixed point along the fixed base and the other end rotatably affixed to the infant apparatus at a second fixed point on the infant apparatus located adjacent the rear of the infant apparatus, each of said at least one first link means and said at least one second link means crossed with respect to each other to form an X therebetween so as to allow said first point to move upwardly and downwardly while simultaneously causing said second point on the infant apparatus to move downwardly or upwardly, respectively, to tilt the infant apparatus to a desired tilt angle.

2. A tilt mechanism as defined in claim 1 wherein said at least one first link means comprises a pair of links and said at least one second link means comprises a pair of links.

3. A tilt mechanism as defined in claim 1 wherein said locking means comprises a hydraulic cylinder.

4. A tilt mechanism as defined in claim 3 wherein said hydraulic cylinder includes a movable piston that is lockable by an operator to a desired position.

5. A tilt mechanism as defined in claim 4 wherein said piston includes a valve operable by an actuator mechanism convenient to the operator for locking said piston position.

6. A tilt mechanism as defined in claim 1 wherein said infant apparatus is an infant incubator.

7. A tilt mechanism for selectively adjusting a tilt angle of an infant apparatus having a front and a rear and adapted to be positioned intermediate the infant apparatus and a fixed base, said tilt mechanism comprising:

at least two sets of crossed links oppositely disposed along the front and rear of the infant apparatus, each of said sets having a pair of links crossed to form an X therebetween, said pairs having one end of each of said links rotatably affixed to the fixed base at a fixed point on said fixed base and the other end of each of said links rotatably affixed to the infant apparatus at a fixed point on the front and the rear of the infant apparatus so as to allow each said fixed points on said infant apparatus to move upwardly or downwardly while simultaneously causing the other fixed point on said infant apparatus to move downwardly or upwardly, respectively, to tilt the infant apparatus to a desired tilt angle.

8. A tilt mechanism for selectively adjusting a tilt angle of an infant apparatus having a front and a rear and adapted to be positioned intermediate the infant apparatus and a fixed base, said tilt mechanism comprising:

at least two sets of crossed links oppositely disposed along the front and rear of the infant apparatus, each of said sets having a pair of links crossed to form an X therebetween, said pairs having one end of each of said links rotatably affixed to the fixed base at a fixed point on the fixed base and the other end of each of said links rotatably affixed to the infant apparatus at a fixed point adjacent the front and the rear of the infant apparatus so as to allow either one of said fixed points on the infant apparatus to move upwardly or downwardly while simultaneously causing the other fixed point on the infant apparatus to move downwardly or upwardly, respectively, to tilt the infant apparatus to a desired tilt angle, and a locking means mounted intermediate the fixed base and the infant apparatus and selectably lockable to lock the infant apparatus in a desired tilt angle with respect to the fixed base.

9. An infant care apparatus for containing an infant said infant apparatus including a fixed base for supporting said infant apparatus, said infant apparatus comprising an infant container having a front and a rear for supporting the infant and being tiltable to a desired tilt angle with respect to said fixed base, a tilt mechanism located intermediate said fixed base and said infant container, said tilt mechanism comprising at least two sets of crossed links oppositely disposed along the front and rear of the infant apparatus, each of said sets having a pair of links crossed to form an X therebetween, said pairs having one end of each of said links rotatably affixed to the fixed base at a fixed point on the fixed base and the other end of each of said links rotatably affixed to the infant container at a fixed point adjacent the front and rear of the infant container so as to allow either one of said fixed points on the infant container to move upwardly or downwardly while simultaneously causing the other fixed point on the infant container to move downwardly or upwardly, respectively, to tilt the infant container to a desired tilt angle, and a locking means mounted intermediate the fixed base and the infant container and selectably lockable to lock the infant container in a desired tilt angle with respect to the fixed base.

10. An infant care apparatus as defined in claim 9 wherein said infant container is an infant incubator.

11. A tilt mechanism as defined in claim 9 wherein said locking means comprises a hydraulic cylinder.

12. A tilt mechanism as defined in claim 11 wherein said hydraulic cylinder includes a movable piston that is lockable by an operator to a desired position.

* * * * *